United States Patent [19]

Xanthopoulos et al.

[11] 4,270,303

[45] Jun. 2, 1981

[54] CONSTRUCTION TILES FOR MAKING TOY WALL PANELS

[75] Inventors: Piritheos G. Xanthopoulos, San Jose; Lloyd W. Stewart, Lafayette, both of Calif.

[73] Assignee: Artzan Corporation, Lafayette, Calif.

[21] Appl. No.: 34,244

[22] Filed: Apr. 30, 1979

[51] Int. Cl.[3] ..... A63H 33/08

[52] U.S. Cl. ..... 46/25; 46/31

[58] Field of Search ..... 46/23, 24, 25, 26, 30, 46/31

[56] References Cited

U.S. PATENT DOCUMENTS

| | | | |
|---|---|---|---|
| 2,119,921 | 6/1938 | Levy | 46/25 |
| 3,334,798 | 8/1967 | Pezely et al. | 46/25 |
| 3,570,170 | 3/1971 | Kishi | 46/25 |
| 3,701,214 | 10/1972 | Sakamoto | 46/25 |

FOREIGN PATENT DOCUMENTS

| | | | |
|---|---|---|---|
| 1108600 | 6/1961 | Fed. Rep. of Germany | 46/25 |
| 1299055 | 1/1963 | France | 46/25 |

*Primary Examiner*—Robert A. Hafer

*Attorney, Agent, or Firm*—Flehr, Hohbach, Test, Albritton & Herbert

[57] ABSTRACT

A toy building tile unit having a surface adapted to provide a building panel, edge margins of the panel being offset on both top and bottom of the tile. One of said offset edge margins carrying means for interlocking with another tile.

13 Claims, 44 Drawing Figures

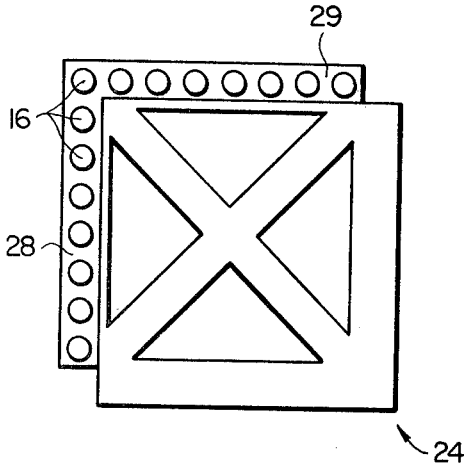
FIG__2A
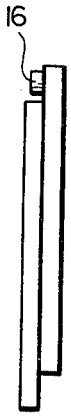
FIG__2B
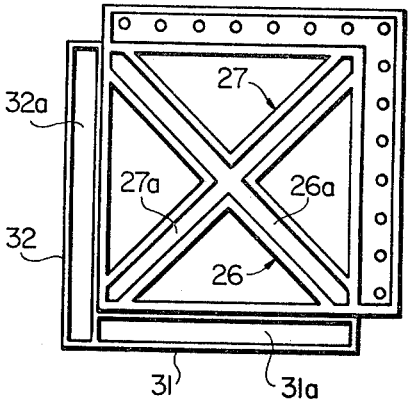
FIG__2C
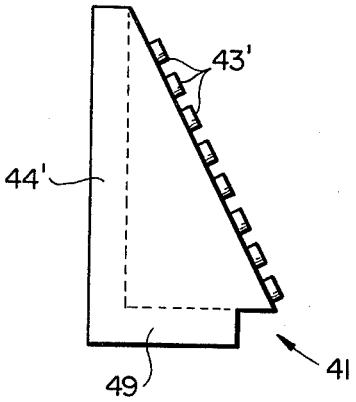
FIG__3A
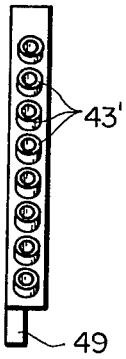
FIG__3B
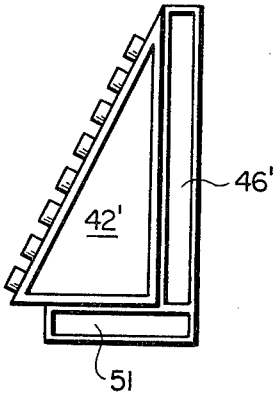
FIG__3C
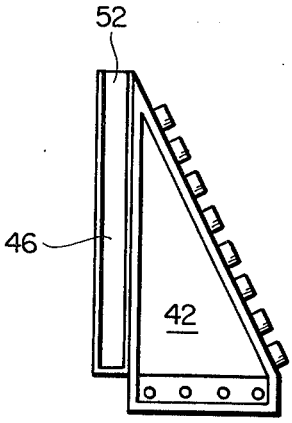
FIG__4A
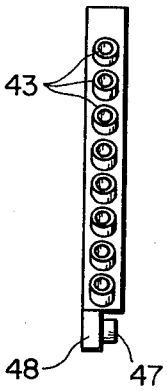
FIG__4B
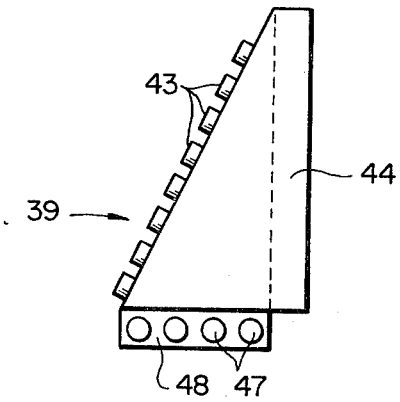
FIG__4C

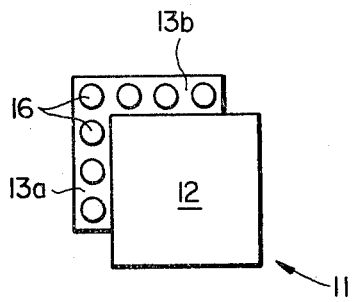
FIG__5A
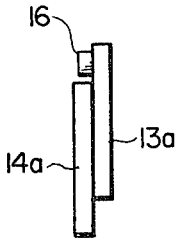
FIG__5B
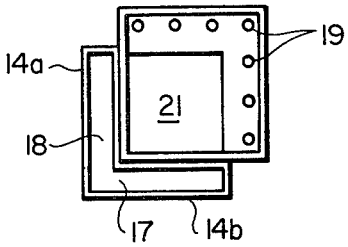
FIG__5C
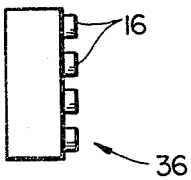
FIG__6A
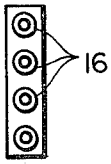
FIG__6B
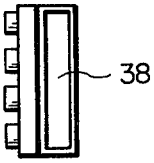
FIG__6C
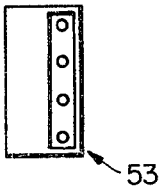
FIG__7A
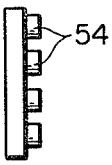
FIG__7B
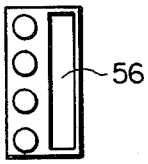
FIG__7C
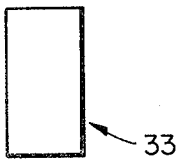
FIG__8A
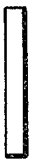
FIG__8B
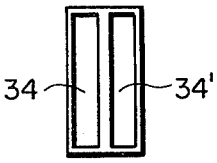
FIG__8C

CONSTRUCTION TILES FOR MAKING TOY WALL PANELS

This invention pertains to Construction Toys employing elements such as tiles, bricks or the like adapted to be interconnected with each other to provide a construction, such as used in buildings, etc. More particularly, this invention pertains to means for assembling broad panels for toy walls and the like.

Heretofore, Construction Toys employing inter-connecting tile elements have been typically characterized by the use of preconstructed walls and roofs to be mounted upon a framework constructed from the tile elements.

In general, there is provided herein construction tiles for building a broad wall panel using a plurality of tiles lying in a common plane and adapted to be used as a roof or wall.

FIG. 1 shows a diagrammatic perspective exploded view of a number of tile units assembled to provide a building structure according to the invention;

FIGS. 2A, B, C, respectively, show front elevation, side elevation and back elevation views of a tile unit according to the invention;

FIGS. 3A, B, C, and 21A, B, C, respectively, show a front elevation, side elevation and back elevation views of triangularly shaped tile units according to the invention;

FIGS. 4A, B, C and 22A, B, C, respectively show back elevation, side elevation and front elevation views of other triangularly shaped tile units according to the invention;

FIGS. 5A, B, C, respectively, show front elevation, side elevation and back elevation views of a rectangularly shaped tile unit according to the invention;

FIGS. 6A, B, C, respectively, show front elevation, side elevation and back elevation views of a tile unit for making corners to the invention;

FIGS. 7A, B, C, respectively, show a back elevation, side elevation and front elevation view of a panel unit for joining adjacent panels;

FIGS. 8A, B, C, respectively, show a front elevation, side elevation and back elevation view of tile unit for joining adjacent tile units;

FIGS. 9A, B, C, respectively, show a front elevation, side elevation section and a back elevation view of a tile unit according to the invention in which the section is taken along the line 9B—9B of FIG. C;

FIGS. 10A, B, C, respectively, show a front elevation, side elevation and back elevation view of a corner conconnecting tile according to the invention;

Figure 1:
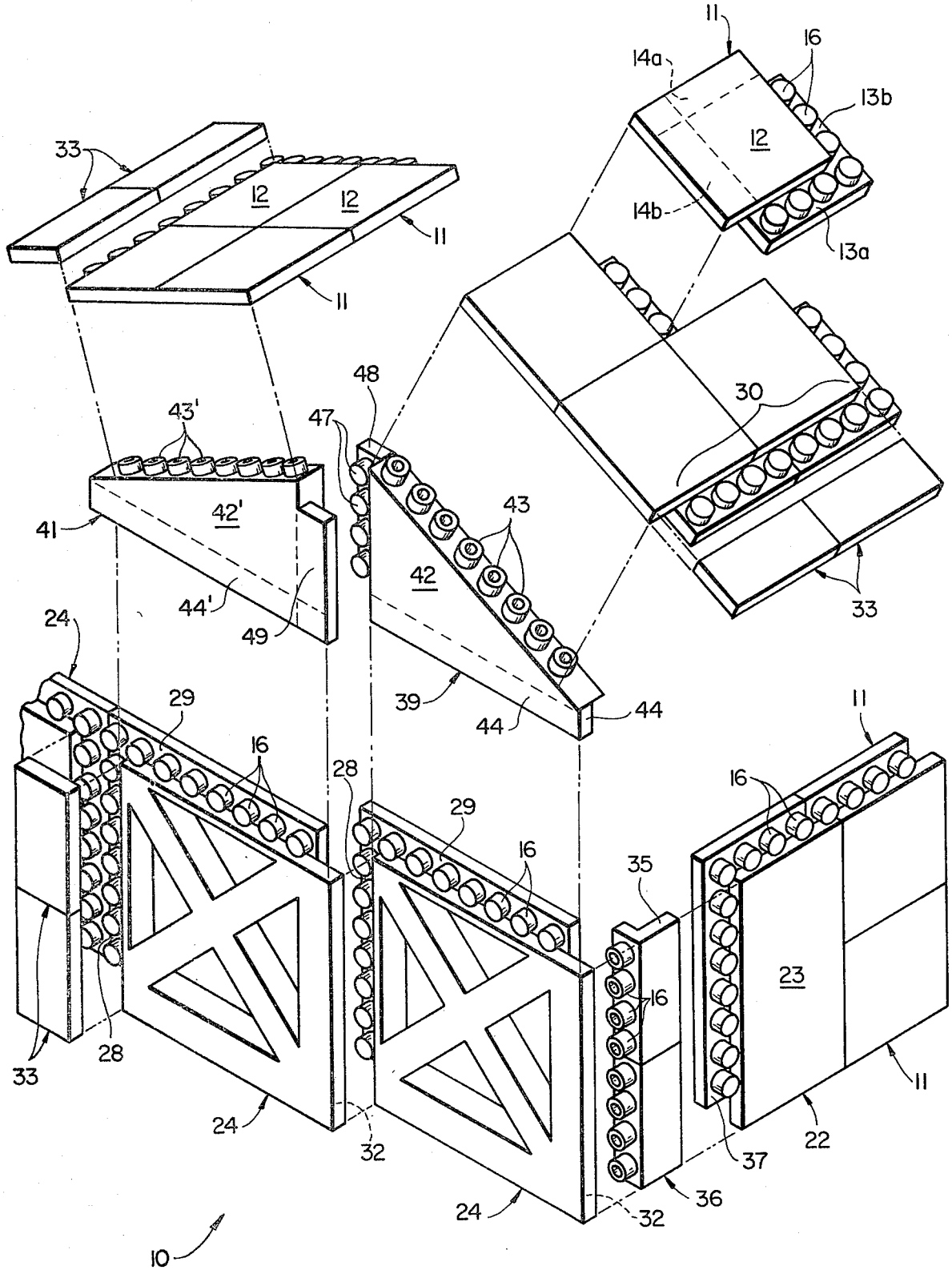
Figure 9A:
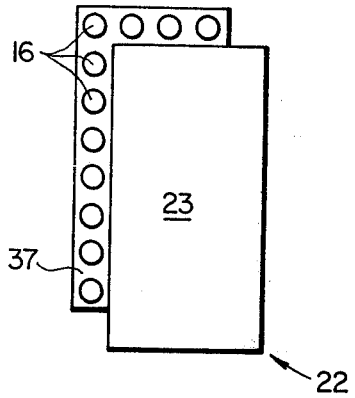
Figure 9B:
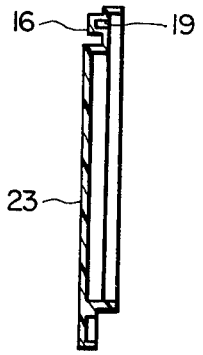
Figure 9C:
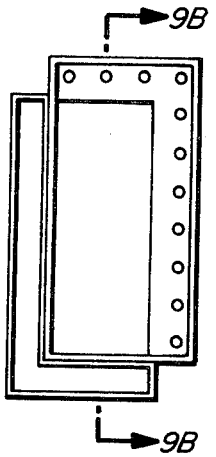

As shown in FIG. 1 an arrangement of tile units according to the invention as described below can serve to provide a building construction 10 or other suitable form. Tiles 11 are formed to comprise a planar surface 12 adapted to provide a building panel. Diagonally offset pairs of adjacent edge margins 13*a*, 13*b* and 14*a*, 14*b* are disposed on both the top and bottom of the tile. Thus, protruding means such as pegs 16 are carried along each of a first offset pair of edge margins, 13*a*, 13*b*, on one side of the tile. Elongate openings 17, 18, formed along each of the other offset pair of edge margins, 14*a*, 14*b* on the other side of the tile serve to receive and engage pegs 16 of another of the tiles 11 for interlocking a plurality of tiles 11 together in a common plane to form a wall-like structure having a substantially continuous surface lying in a common plane.

As shown best in FIG. 5, by forming tile 11 from plastic a substantial amount of material can be removed from behind the body of the element. Thus, each of pegs 16 has been formed with an opening 19, centrally thereof. Further, material has been removed to form a substantially square relieved portion 21.

As shown in FIG. 1, tiles 11 provide a panel surface 12 which is substantially square. Other configurations of these panels have also been provided and shown such as the tile 22 characterized by an elongate rectangular panel surface 23. Similarly, tile 22 includes the offset edge margins which characterize tiles 11.

Further, as shown in FIG. 1, relatively large tiles 24 can also be characterized by diagonally offset edge margins carrying coupling means such as a series of pegs thereon or slots fomed therein. Tiles 24, in addition, incorporate a configuration of a type which can be readily removed from a mold. As shown in FIG. 2C, the back side of tile 24 includes a configuration comprising a pair of cross-members 26, 27 formed to include slots 26*a*, 27*a* adapted to receive pegs 16 therein. Tile 24 includes a diagonally offset pair of edge margins 28, 29 for carrying pegs 16 as viewed from the front in FIG. 2A, as well as a pair of diagonally offset edge margins 31, 32, as viewed from the back side of tile 24. Each of edge margins 31, 32 includes an elongate slot 31*a*, 32*a* respectively for receiving and engaging pegs 16.

Figure 11:
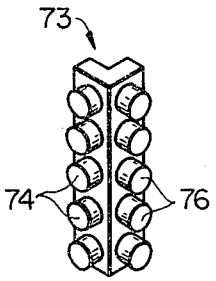
FIG. 11 shows a perspective view of a corner connecting tile according to another embodiment of the tile shown in FIG. 6A–C.

As shown in FIG. 11 a pair of tile elements 24 can be readily coupled together by inserting the pegs 16 of edge margin 28 into slot 32*a* of edge margin 32. After the two tiles 24 are coupled together their outer surfaces will lie in the same plane.

In those circumstances where a pair of tile units such as 24 are disposed adjacent to each other with those edge margins 28, 29 carrying pegs 16 thereon are in contiguous relation in the same plane, means are provided forming a connection. A tile element 33 is provided for retaining tile units 24 in such contiguous relation as shown in FIG. 1 and FIG. 8.

Accordingly, tile element 33 provides a panel member formed to include a pair of spaced parallel retaining slots 34, 36 on one face of member 33 for engaging and holding the protruding pegs 16 of each of the adjacent pair of offset edge margins 28 or 29 respectively, in an associated one of the slots.

It will be readily evident that tile elements 33 can also be employed for joining adjacent tiles 11 where the adjacent edges include protruding pegs.

In addition to the foregoing, tile 33 can be used to "finish off" those edges of a structure built by an assemblage of tiles where the edges include protruding pegs. For example, as shown in FIG. 1, tiles 33 are disposed onto the line 30 of pegs 16 so as to form an overhanging eave for the building construction shown while covering the pegs.

Means are further provided for coupling tile units in a manner so as to provide a corner for a building.

Thus, tile elements 36 serve to join the overhanging edge margin 32 of tile 24 with the overhanging edge margin 37 of tile 22 disposed adjacent to and at right angles with edge margin 32.

Accordingly, tile 36 serves to join tiles 24, 22, to form a corner therebetween, having smooth surfaces therearound and comprises an L-shaped tile as viewed in plan. Pegs or other protruding elements extend outwardly from the face of one leg of the L and engage retaining opening 32*a* formed in edge margin 32 (FIG. 2C). An opening 38 formed into the back wall of the other leg 34 of the L of tile 36 serves to receive and engage pegs protruding outwardly from edge margin 37 of tile 22.

As thus arranged when the corner is fully assembled there will be a continuous smooth surface on the two sides of the corner as well as at the corner.

As thus arranged means have been described for constructing the side walls of a toy building and for joining adjacent tile elements as well as for providing a corner of the building.

Means, as now described, serve to provide the supports for constructing a roof for the foregoing structure.

Thus, as shown in FIGS. 1, 3 and 4, right triangular tiles 39, 41 are provided in the manner to be adapted to be coupled together and attached to the upper row of pegs on each of tiles 24 as now to be described.

Tiles 39, 41 each comprise a right triangularly shaped body portion 42, 42' a series of protruding peg elements 43, 43' are disposed along the hypotenuse of the triangle and lie normal thereto in the plane of body portion 42, 42', respectively.

A flange 44, 44' formed along the base of the triangular body 42, 42' and flush therewith carries coupling means such as the elongate slot 46, 46' for engaging the pegs along the top edge of units 24 when tile elements 39, 41 are coupled together or when elements 39, 41 are coupled to other tiles disposed between edge margins 48, 49.

Thus, one of the two tiles such as 39 carries coupling means in the form of pegs 47 disposed along a displaced edge margin 48 whereas the edge margin 49 of tile 41 carries a cooperating coupling means in the form of an elongate slot 51.

Accordingly, each tile 39, 41 includes an overhanging edge margin 44, 44' along one side of the tiles 39, 41. Another side of tiles 39, 41 includes flanges 48, 49. Coupling means are carried by the flanges 48, 49. Coupling means are also carried along edge margins 44, 44' on the third side of the triangular body.

As thus arranged, it is evident that flanges 48, 49 carry coupling means respectively accessible from the front and back faces of flanges 48, 49.

As shown in FIG. 4A, slot 46 is open at one end in order to permit tile 39 to be moved slightly relative to a tile coupled thereto. Thus, the open end 52 serves to permit a minor degree of adjustment which sometimes is quite desirable when interconnecting the coupling means of flanges 48, 49.

In addition to the above, the back sides of elements of tiles 39, 41 are relieved substantially in oder to minimize the amount of material employed in making these components.

As noted above with respect to tile 33 used to join adjacent tiles in which parallel columns of pegs 16 are disposed adjacent one another, it is readily evident that in building a toy construction, of the kind described, it is possible to encounter situations in which the adjacent coupling portions of two adjacent tiles will be different for each of the two tiles. For example, a column of pegs may be disposed alongside an elongate slot. Thus, where a pair of tile units are disposed adjacent to each other and the adjacent edge margins are charaterized respectively by an elongate slot and protruding means such as pegs, means for retaining the tile units in contiguous relation while forming a continuous surface therebetween comprises a panel member 53 formed to include on the same face of the member protruding means such as pegs 54 and an opening 56 respectively adapted to engage an opening and pegs of the adjacent tile units.

Figure 10A:
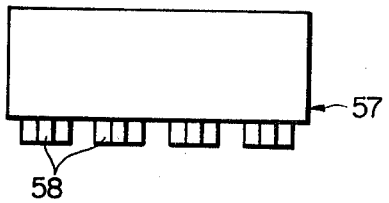
Figure 10B:
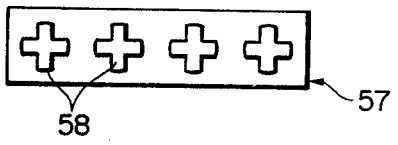
Figure 10C:
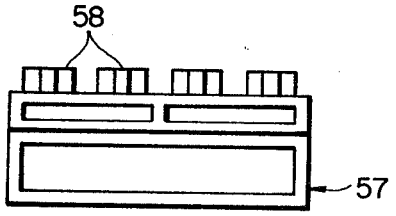

Tile 36 described with respect to FIG. 6 above, serves to form a corner as noted. Tile 57 of FIG. 10 functions similarly to tile 36 but is characterized by pegs 58 having a cross-section in the form of a cross. It is to be noted that in molding a corner tile 36 (FIG. 6) openings are formed into the tile along mutually perpendicular axes which can increase the expense of molding these tiles 36. However, by forming the pegs to have a cross-shaped section the cost of molding can be reduced.

Figure 21A:
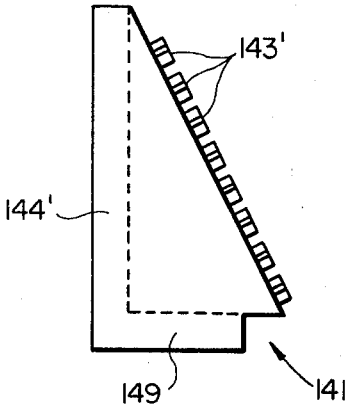
Figure 21B:
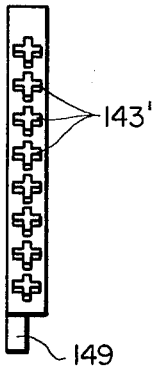
Figure 21C:
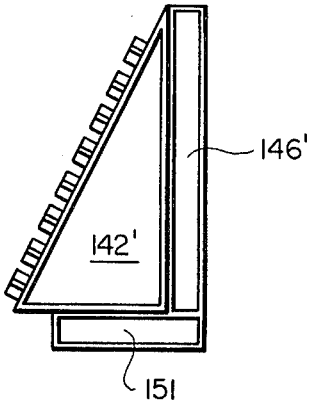
Figure 22A:
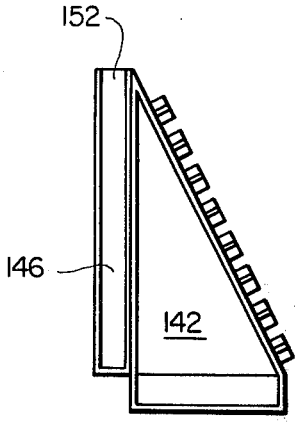
Figure 22B:
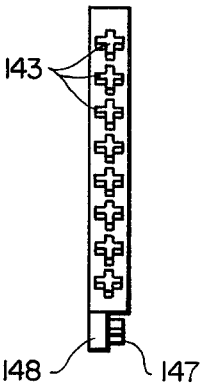
Figure 22C:
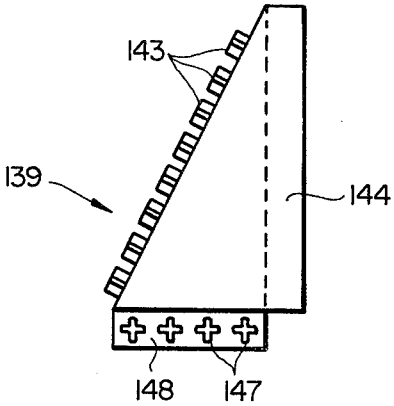

Similarly, tiles 39, 41 have the same consideration in that slots 46, 51 are formed from one direction and pegs 43 from another. Thus, as shown in FIGS. 21 and 22 tiles 139, 141 similar to tiles 39, 41 are shown but with pegs having a cross-shaped section. The portions of tiles 139, 141 are designated by the same reference numerals used with respect to similar portions of tiles 39, 41 but with the addition of a third order digit "1". Further explanation is therefore not believed required.

Figure 15:
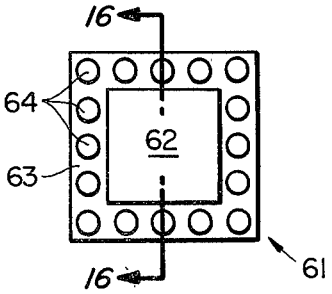
FIG. 15 shows a plan view of an enlarged panel element characterized by protruding pegs disposed around its four edge margins.
Figure 16:
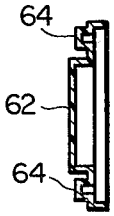
FIG. 16 shows a side elevation section view taken along the line 16—16 of FIG. 15.
Figure 17:
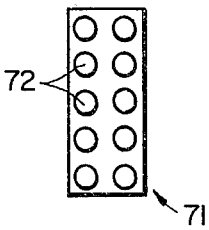
FIG. 17 shows a plan view of a connecting tile for use in the embodiment shown in FIG. 13.
Figure 18:
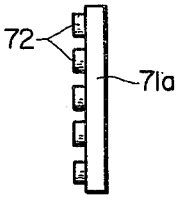
FIG. 18 shows a side elevation view of FIG. 17.

As shown in FIG. 15 a rectangularly shaped tile 61 comprises a central panel portion 62 surrounded by a skirt 63 of reduced thickness formed to include a sequence of pegs 64 therearound. Panels 61, as shown in FIG. 12, are coupled together by means of tiles 33.

In order to make a corner with a construction of the above kind, an L-shaped tile 36, as shown in FIG. 6, is disposed onto pegs 64. In this manner, a smooth corner can be formed by applying a tile 33 to the pegs 16 of tile 36 disposed alongside pegs 64 of tile 61.

Figure 12:
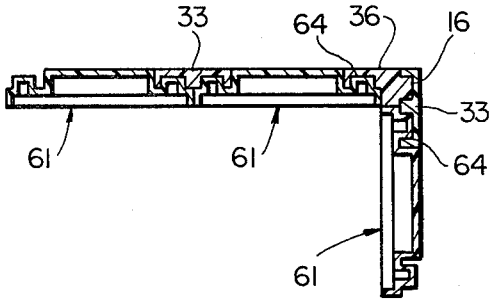
FIG. 12 shows a section view in plan of a wall construction including a corner utilizing the tiles of FIGS. 6, 8 and 15 according to the invention.

In order to provide a smooth continuous surface on the exterior of the construction as shown in FIG. 12, it is necessary that the plane of the outer surfaces of pegs 64 and the plane of panel portion 62 lie in spaced relation corresponding to the spacing between the inner ends of openings 34, 36 and the outer surface of tile 33.

Figure 19:
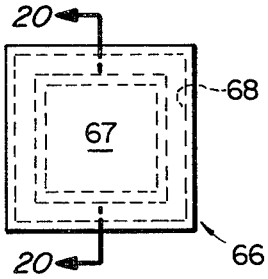
FIG. 19 shows a plan view of a tile unit according to another embodiment characterized by a retaining groove disposed around the tile beneath an overhanging edge margin thereof.
Figure 20:
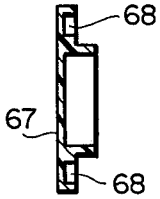
FIG. 20 shows a side elevation section of FIG. 19 taken along the line 20—20 thereof.

Tile 66 shown in FIG. 19 comprises a relatively large panel portion 67 adapted to be coupled to other tiles by means coupling an elongate slot 68 defined beneath and around the overhanging edge margin of panel portion 67.

Figure 13:
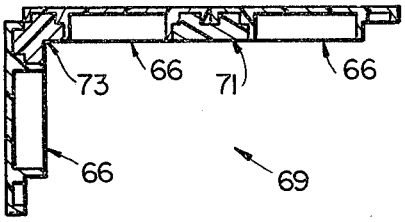
FIG. 13 shows a plan view in section of a wall construction including a corner utilizing the tiles of FIGS. 11, 17 and 14 according to the invention.
Figure 14:
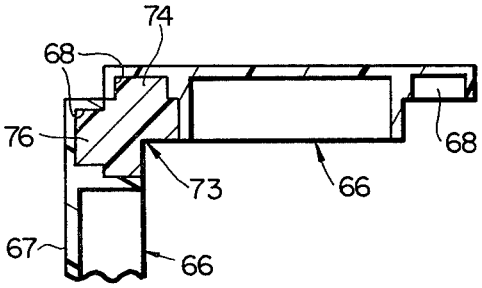
FIG. 14 shows an enlarged detail of FIG. 13.

In constructing a wall as shown in FIGS. 13 and 14, tiles 66 can be disposed with their broad panel portions 67 to the outside and joined in back by means of coupling tiles 71 comprising a rectangular body portion 71*a* supporting a plurality of pegs 72 disposed in a pair of columns for engaging adjacent slots 68 of tiles 66. In this manner tiles 66 can be maintained in a plane to form a wall.

In order to make corners, a tile 73 having an L-shaped configuration as viewed in plan carries means protruding outwardly from the face of each leg of the L for engaging a retaining opening 68 formed behind an edge margin of tile units 66 when the tiles are disposed adjacent to and at right angles to each other.

Thus, pegs 74, 76 engage slots 68 of tiles 66 to hold them at right angles to each other.

The diagonal offset of the adjacent edge margins such as 13*a*, 13*b* for tile 11 and others serve to permit edge margin 14*b* to overlay and be engaged by pegs 16 carried by an edge margin 13*b* of an adjacent tile. At the same time, edge margin 13*a* is permitted to be positioned beneath an adjacent tile by virtue of the fact that the lower edge margins thereof have been diagonally displaced from the panel portion of the element. The foregoing form of cooperation is highly advantageous inasmuch as it leaves the surface substantially free of any uncovered pegs, other than along two edges which can be finished off by tiles such as 33.

We claim:

1. A tile unit for use in constructing toy structure, said unit being formed to comprise a surface configuration adapted to provide a building panel, pairs of adjacent edge margins on both the top and bottom of the panel, said pairs being mutually displaced with respect to each other diagonally of said panel to define offset pairs of edge margins, protruding means carried along each of the first offset pair of edge margins on one side of said tile, and an elongate opening formed along each of the other offset pair of edge margins on the other side of said tile for receiving and engaging said protruding means of another of said tiles for interlocking a plurality of tiles together in a common plane to form a wall-like structure.

2. In a toy structure comprising a pair of tile units according to claim 1 disposed adjacent to each other and with said first offset pair of edge margins in contiguous relation, in the same plane and means for retaining said tile units in said contiguous relation comprising a panel member formed to include a pair of spaced parallel retaining slots on one face of said member for engaging and holding said protruding means of each of said first offset pair of edge margins respectively in an associated one of said slots.

3. In a toy structure comprising a pair of tile units according to claim 1 disposed with an overhanging edge margin of one of said units adjacent to and at right angles with respect to an overhanging edge margin of another unit, and means for retaining said tile units in said relation to form a corner therebetween having smooth surfaces therearound comprising an L-shaped tile as viewed in plan, means protruding outwardly from the face of one leg of the L for engaging a retaining opening formed behind an edge margin of one of said tile units, and an opening formed into the back wall of the other leg of the L for receiving and engaging means protruding outwardly from another edge margin of another of said tile units.

4. In a toy structure comprising a pair of tile units according to claim 1 disposed adjacent to each other with one of said first offset pair of edge margins being disposed adjacent one of said other offset pair of edge margins in the same plane to dispose said protruding means of the first named edge margin adjacent said opening in the second named margin, and means for retaining said tile units in contiguous relation comprising a panel member formed to include on the same face of said member protruding means and an opening respectively adapted to engage an opening and protruding means of the pair of tile units.

5. A tile unit for use in constructing toy buildings comprising a right triangularly shaped body portion, a plurality of protruding first coupling portions disposed along the hypotenuse of the triangle and lying normal thereto in the plane of said body portion, a flange formed along one said of the triangular body, second coupling means carried by said flange, and third coupling means carried along an edge margin of the third side of said triangular body.

6. A tile unit according to claim 5 in which said second coupling means is disposed to be accessible from the front face of said flange.

7. A tile unit according to claim 5 in which said coupling means is disposed to be accessible from the back face of said flange.

8. A tile unit according to claim 5 in which said second coupling means comprises a series of pegs protruding in a direction normal to said flange.

9. A tile unit according to claim 5 in which said second coupling means comprises an elongate slot formed in said flange for receiving protruding means therein of another tile unit.

10. A tile unit according to claim 5 in which said third coupling means comprises an elongate slot formed along the reverse surface of said edge margin of said third side of said triangular body, the last named said slot having a width serving to engage the sides of means protruding from another similar tile for coupling said tile with another and a depth serving to cause the coupled tiles to lie in the same plane.

11. A tile unit according to claim 10 in which said slot is open at one end in order to permit said tile unit to be moved relative to a tile unit coupled thereto.

12. In a toy structure comprising a pair of tile units wherein each tile unit is formed to comprise a surface configuration adapted to provide a building panel, pairs of adjacent edge margins on both the top and bottom of the tile mutually offset diagonally with respect to the panel, protruding means carried along each of the first offset pair of edge margins on one side of said tile, and an elongate opening formed along each of the other offset pair of edge margins on the other side of said tile for receiving and engaging said protruding means of another of said tiles for interlocking a plurality of tiles together in a common plane to form a wall-like structure, disposed adjacent to each other in the same plane with said second offset pair of edge margins in contiguous relation to dispose said elongate openings thereof in mutually parallel relation, and means for retaining said tile units in said contiguous relation comprising a panel member formed to include a pair of spaced parallel columns of protruding means carried on the same face of said member for entering said elongate slots respectively and holding said tiles together by engaging said slots of each of said second offset pair of edge margins.

13. A tile unit for use in constructing toy structures, said unit being formed as a body comprising a panel, a pair of edge margins adjacent said panel respectively on the front and back sides of the tile, said edge margins being disposed to extend in intersecting directions, retaining means carried along one of said edge margins and operable from only one side of said tile, means carried along an adjacent edge margin and operable from only the other side of said tile for engaging said retaining means, a third edge extending diagonally between the remote ends of said edge margins, and retaining means carried by said third edge for engaging portions of another tile, said retaining means protruding away from said third edge in the plane of said panel.

* * * * *